US008235736B2

(12) United States Patent
Watanabe et al.

(10) Patent No.: US 8,235,736 B2
(45) Date of Patent: Aug. 7, 2012

(54) CONNECTOR

(75) Inventors: Masahide Watanabe, Tokyo (JP); Takeshi Shindo, Tokyo (JP); Takahiro Yamaji, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 13/176,493

(22) Filed: Jul. 5, 2011

(65) Prior Publication Data

US 2012/0009821 A1 Jan. 12, 2012

(30) Foreign Application Priority Data

Jul. 6, 2010 (JP) ..... 2010-154331

(51) Int. Cl.
*H01R 13/648* (2006.01)

(52) U.S. Cl. ..... 439/108

(58) Field of Classification Search ..... 439/108, 439/101, 637, 607.08, 607.09, 607.27, 607.28, 439/607.37
See application file for complete search history.

(56) References Cited

U.S. PATENT DOCUMENTS 6,663,425 B1 * 12/2003 Zhang et al. ..... 439/607.35
7,281,943 B1 * 10/2007 Yamaji ..... 439/495
7,396,258 B2 * 7/2008 Zhang ..... 439/660
7,402,081 B2 * 7/2008 Si et al. ..... 439/607.04
8,105,111 B2 * 1/2012 Chen ..... 439/607.04
2007/0072463 A1 * 3/2007 Suzuki et al. ..... 439/157
2009/0227129 A1 * 9/2009 Mao et al. ..... 439/108

FOREIGN PATENT DOCUMENTS

JP 2004-319196 A 11/2004
JP 2009-193916 A 8/2009

* cited by examiner

*Primary Examiner* — Tulsidas C Patel
*Assistant Examiner* — Phuongchi Nguyen
(74) *Attorney, Agent, or Firm* — Holtz, Holtz, Goodman & Chick, PC

(57) ABSTRACT

A connector is connectable to a cable having a plurality of signal wires and a drain wire. Each of the signal wires includes a signal conductor. The connector comprises a plurality of contacts, a holding member and a shell. The holding member is provided with an accommodating portion configured to accommodate an end part of the drain wire. The accommodating portion extends through the holding portion along a predetermined direction. The contacts configured to be connected to the signal conductors, respectively. The contacts are held by the holding member so that connection works between the contacts and the signal conductors are performable along the predetermined direction. The shell covers, at least in part, the holding member. The shell has a fixing portion exposed in the accommodating portion so that the end part of the drain wire is fixable to the fixing portion within the accommodating portion.

11 Claims, 5 Drawing Sheets

CONNECTOR

CROSS REFERENCE TO RELATED APPLICATIONS

Applicants claim priority under 35 U.S.C. §119 of Japanese Patent Application No. JP2010-154331 filed Jul. 6, 2010.

BACKGROUND OF THE INVENTION

This invention relates to a connector which is connectable to a cable having a plurality of signal wires and a drain wire.

For example, a connector connectable to a cable having a plurality of signal wires is disclosed in JP-A 2009-193916, contents of which are incorporated herein by reference. However, JP-A 2009-193916 does not disclose a manner to connect a drain wire to the connector.

For example, a connector having a portion which is configured to be connected to a drain wire or a shield wire is disclosed in JP-A 2004-319196, contents of which are incorporated herein by reference. However, complicated works are required to connect the drain wire to the cable of JP-A 2004-319196.

SUMMARY OF THE INVENTION

It is therefore an object of the present invention to provide a connector which can be connected, more efficiently in a connection process, to a cable having a plurality of signal wires and a drain wire.

One aspect of the present invention provides a connector connectable to a cable having a plurality of signal wires and a drain wire. Each of the signal wires includes a signal conductor. The connector comprises a plurality of contacts, a holding member and a shell. The holding member is provided with an accommodating portion configured to accommodate an end part of the drain wire. The accommodating portion extends through the holding portion along a predetermined direction. The contacts configured to be connected to the signal conductors, respectively. The contacts are held by the holding member so that connection works between the contacts and the signal conductors are performable along the predetermined direction. The shell covers, at least in part, the holding member. The shell has a fixing portion exposed in the accommodating portion so that the end part of the drain wire is fixable to the fixing portion within the accommodating portion.

An appreciation of the objectives of the present invention and a more complete understanding of its structure may be had by studying the following description of the preferred embodiment and by referring to the accompanying drawings.

Figure 1:
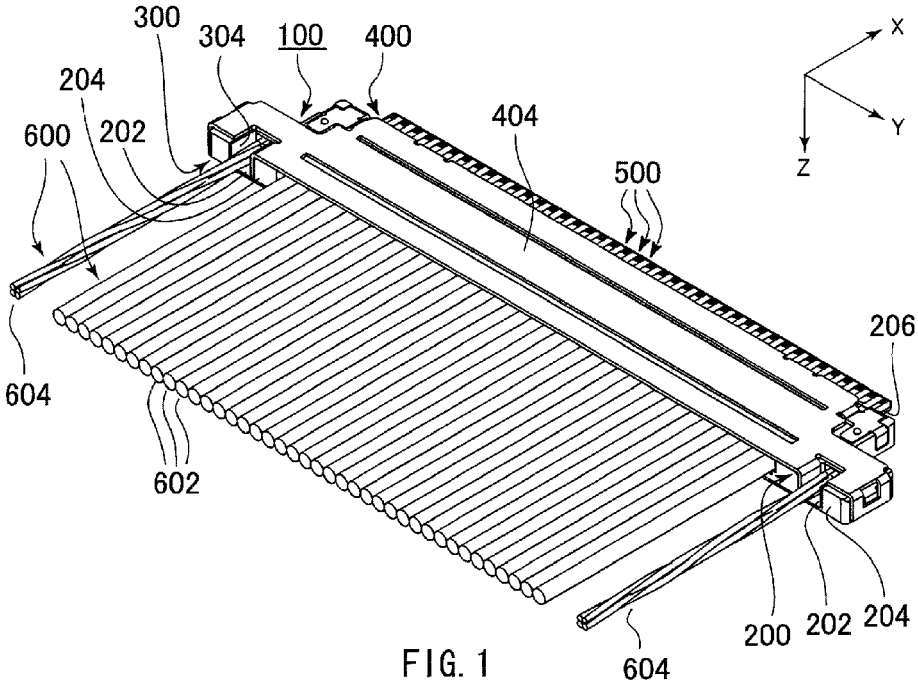
FIG. 1 is a perspective view showing a connector (first connector) according to an embodiment of the present invention, wherein the connector is connected to a cable.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
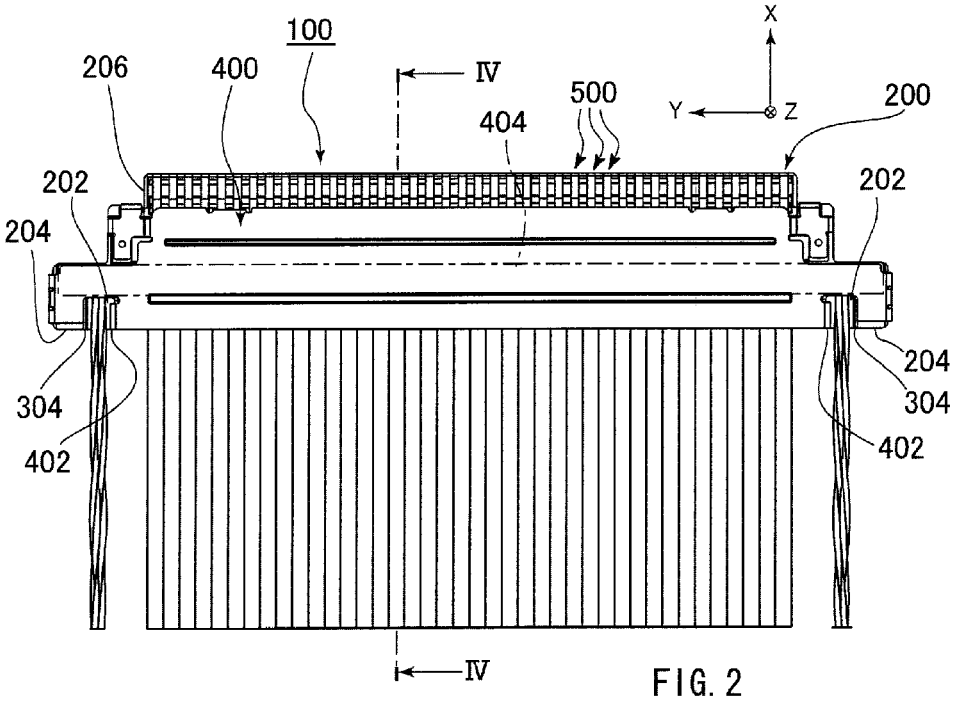
FIG. 2 is a top view showing the connector of FIG. 1. Cutting plane lines IV-IV define a XZ-plane which passes through a central axis of one of signal wires.
Figure 3:
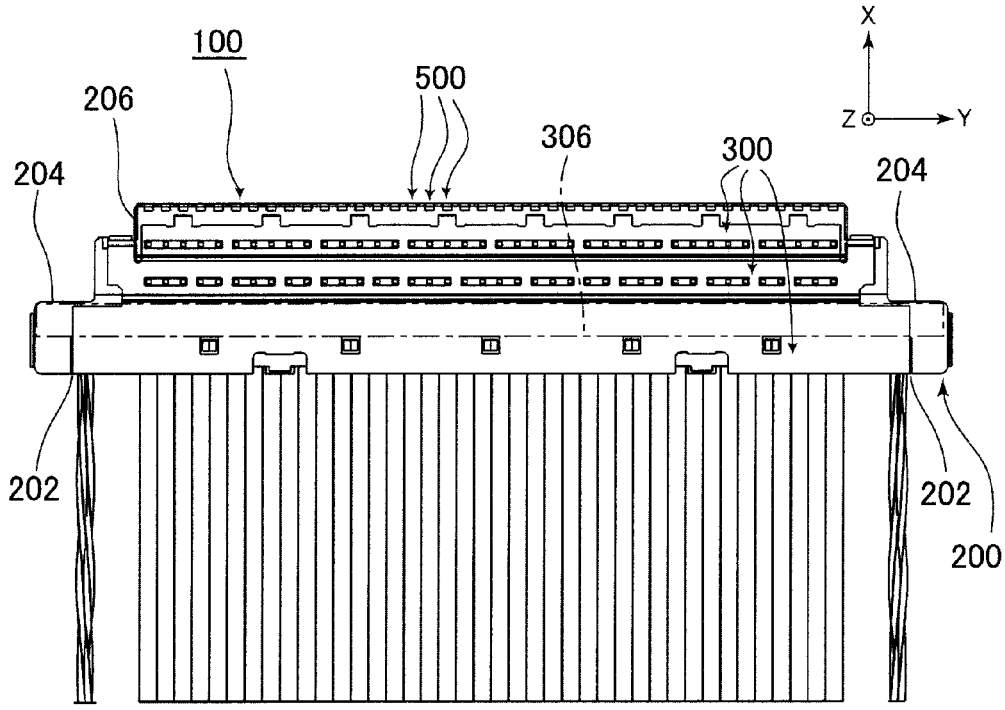
FIG. 3 is a bottom view showing the connector of FIG. 1.

As shown in FIGS. 1 to 3, a connector 100 according to an embodiment of the present invention has a board-like shape. The connector 100 extends long in a left-to-right direction (Y-direction). The connector 100 is connectable to a cable 600 having a plurality of signal wires (discrete wires) 602 and a drain wire 604. Each of the signal wires 602 includes a signal conductor 603 and a dielectric insulator 605 surrounding the signal conductor 603 (see FIG. 4). The connector 100 includes a plurality of contacts 500 made of conductive materials, a holding member 200 made of an insulating material, a base shell (shell) 300 made of a conductive material and a cover shell (shell) 400 made of a conductive material. The contacts 500 are configured to be connected to the signal conductors 603, respectively. The holding member 200 holds the contacts 500. The holding member 200 has a top surface and a bottom surface opposing to each other in a top-to-bottom direction (Z-direction). The holding member 200 also has a rear end portion and a front end portion (end portions, collectively) opposing to each other in a front-to-rear direction (negative X-direction). The base shell 300 covers mainly the bottom surface of the holding member 200. On the other hand, the cover shell 400 covers mainly the top surface of the holding member 200. In other words, the shell consisting of the base shell 300 and the cover shell 400 covers, at least in part, the holding member 200.

Figure 8:
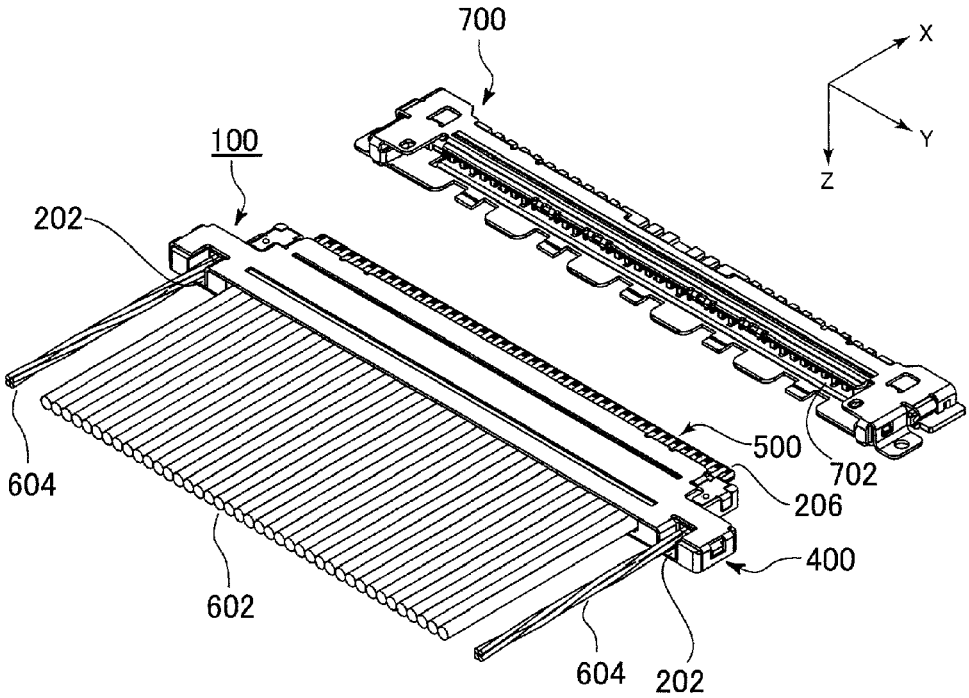
FIG. 8 is a perspective view showing the first connector of FIG. 1 and a second connector, wherein the first connector is separated from the second connector.
Figure 9:
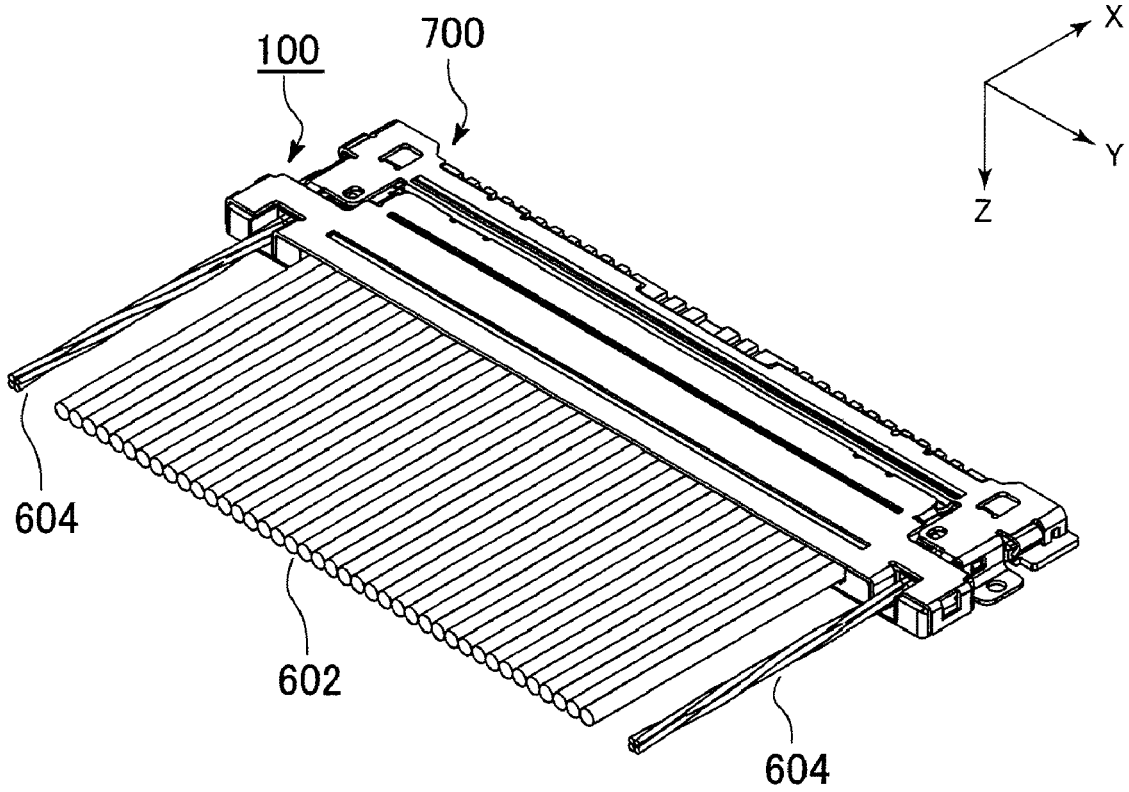
FIG. 9 is a perspective view showing the first connector of FIG. 1 and the second connector of FIG. 8, wherein the first connector is connected to the second connector.

The connector (first connector) 100 according to the present embodiment is a plug connector having a mating projection 206. The mating projection 206 is formed on the front end portion of the holding member 200. The mating projection 206 projects out along the positive X-direction (frontward) while extending along the Y-direction. The first connector 100 is configured to be mated with a second connector (mating connector) 700. As shown in FIG. 8, the second connector 700 is a receptacle connector having a mating depression 702. The mating depression 702 is formed on an end of the second connector 700. The mating depression 702 has a shape matable with the mating projection 206. As shown in FIG. 9, the mating projection 206 of the connector (first connector) 100 is mated with the mating depression 702 of the second connector 700 so that a connector assembly is formed.

As shown in FIGS. 1 to 3, the holding member 200 is formed with opposite projecting portions 204 on the rear end portion. The projecting portions 204 project out rightward (in the positive Y-direction) and leftward (in the negative Y-direction), respectively. The projecting portions 204 are formed with accommodating portions 202, respectively. The accommodating portion 202 is configured to accommodate an end part of the drain wire 604. The connector 100 has a height or thickness in the Z-direction (predetermined direction). The accommodating portion 202 extends through the holding member 200 from the top surface to the bottom surface along the predetermined direction. The accommodating portion 202 has an opening. The opening is formed on a surface of the rear end portion (on a rear end surface in the X-direction) of the holding member 200.

Figure 4:
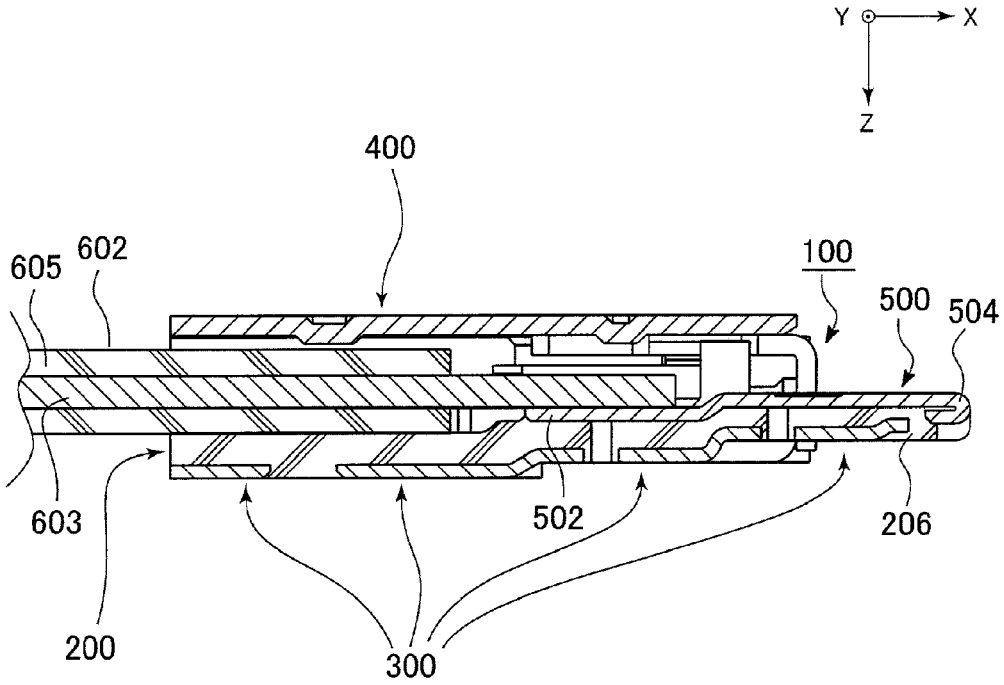
FIG. 4 is a cross-sectional view showing the connector, taken along lines IV-IV of FIG. 2.

As can be seen from FIG. 4, the contacts 500 are arranged so that the signal conductors 603 can be connected to the contacts 500 along a predetermined direction. In detail, the contact 500 is arranged to extend along the X-direction (extending direction) so that the contact 500 has a rear end 502 and a front end 504 in the X-direction. The contact 500 is insert-molded into the holding member 200. The rear end 502 is connectable to the signal conductor 603. The front end 504 of the contact 500 extends to a tip of the mating projection 206 along the top surface of the holding member 200. The front end 504 has a tip portion, which is folded back and extends rearward (in the negative X-direction). The tip portion is buried in the holding member 200. As shown in FIGS. 1 to 3, the contacts 500 are held by the holding member 200 so as to be arranged in the Y-direction (pitch direction) perpendicular to the Z-direction (predetermined direction).

As can be seen from FIG. 4, when the cable 600 is connected to the connector 100, the signal conductor 603 of each signal wire 602 is placed on the rear end 502 of the corresponding contact 500 and is soldered thereto along the Z-direction (predetermined direction). As shown in FIG. 1, the connector 100 is configured so that the cable 600 extends in the X-direction (extending direction) perpendicular to the Z-direction (predetermined direction) when the cable 600 is connected to the connector 100.

The connector 100 according to the present embodiment is provided with two separated shells, namely, the base shell 300 and the cover shell 400 so that the connector 100 can be formed with a low-profile or a reduced height. In detail, when the holding member 200 is formed, the base shell 300 is installed into the holding member 200 by insert-molding. On the other hand, the cover shell 400 is attached to the holding member 200 after the cable 600 is connected to the connector 100.

As can be seen from FIGS. 1, 3 and 4, the base shell 300 is insert-molded into the bottom surface of the holding member 200 so as to expose its undersurface on the bottom surface of the holding member 200. As shown in FIG. 3, the base shell 300 covers most part (i.e. at least in part) of the bottom surface of the holding member 200 so that the connector 100 is formed with a second plane 306 on a bottom surface thereof. As can be seen from FIGS. 2 and 3, the second plane 306 has a belt-like shape which extends in the Y-direction (pitch direction) so as to cover two second covered positions near the accommodating portions 202, respectively. Each of the second covered positions is close to the accommodating portion 202 in the X-direction (extending direction) and corresponds to a position of the accommodating portion 202 in the pitch direction.

As shown in FIGS. 1, 2 and 4, the cover shell 400 is attached to the connector 100 from above the holding member 200 in a state where the signal wires 602 are connected to the connector 100. The cover shell 400 covers most part (i.e. at least in part) of the top surface of the holding member 200 so that a top surface of the connector 100 is formed with a first plane 404. As shown in FIGS. 1 and 2, the first plane 404 has a belt-like shape which extends in the Y-direction (pitch direction) so as to cover two first covered positions near the accommodating portions 202, respectively. Each of the first covered positions is close to the accommodating portion 202 in the X-direction (extending direction) and corresponds to a position of the accommodating portion 202 in the pitch direction. The first plane 404 and the second plane 306 are arranged to sandwich the holding member 200 in the Z-direction (predetermined direction) so that an electrical shielding tape can be stuck to each of the first plane 404 and the second plane 306 in a high adhesive manner.

Figure 5:
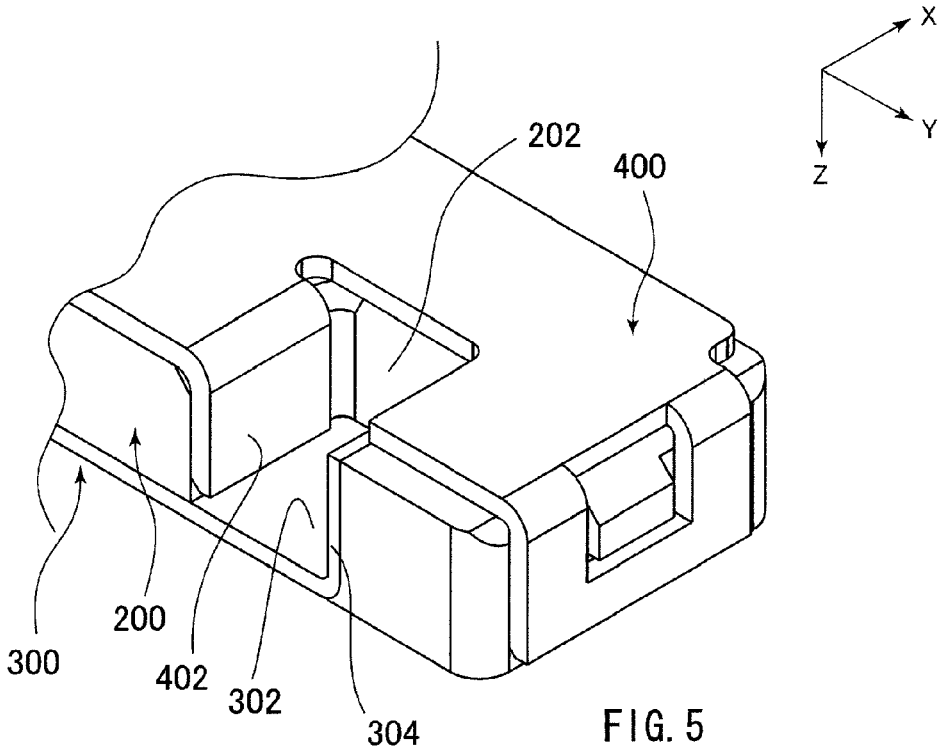
FIG. 5 is a partially enlarged, perspective view showing around an accommodating portion of the connector of FIG. 1, wherein the connector is not connected to a drain wire.
Figure 6:
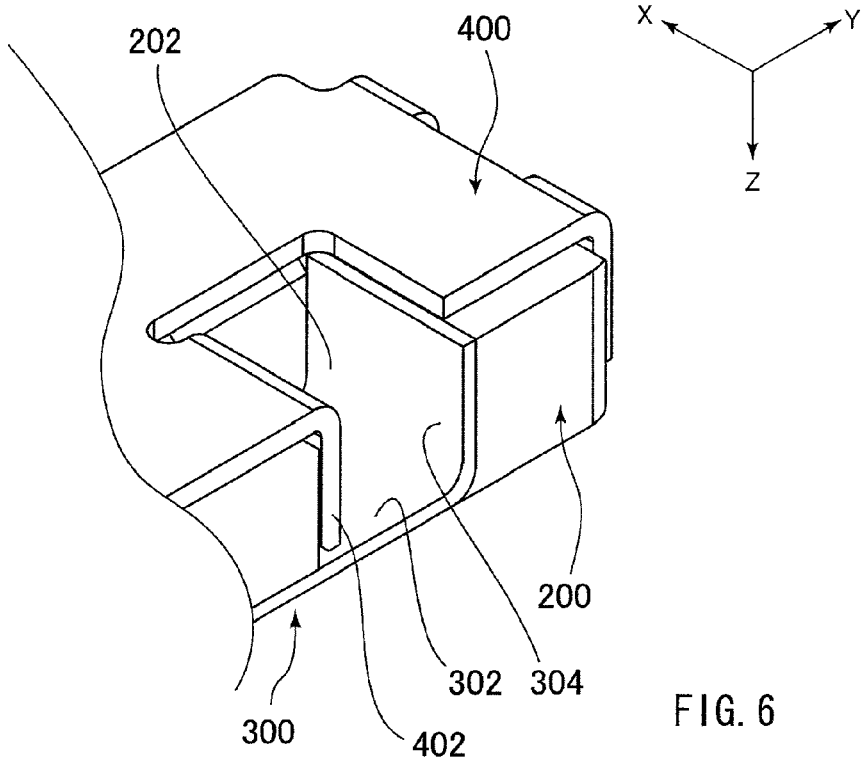
FIG. 6 is a partially enlarged, perspective view showing around the accommodating portion of FIG. 5, as seen along other direction.
Figure 7:
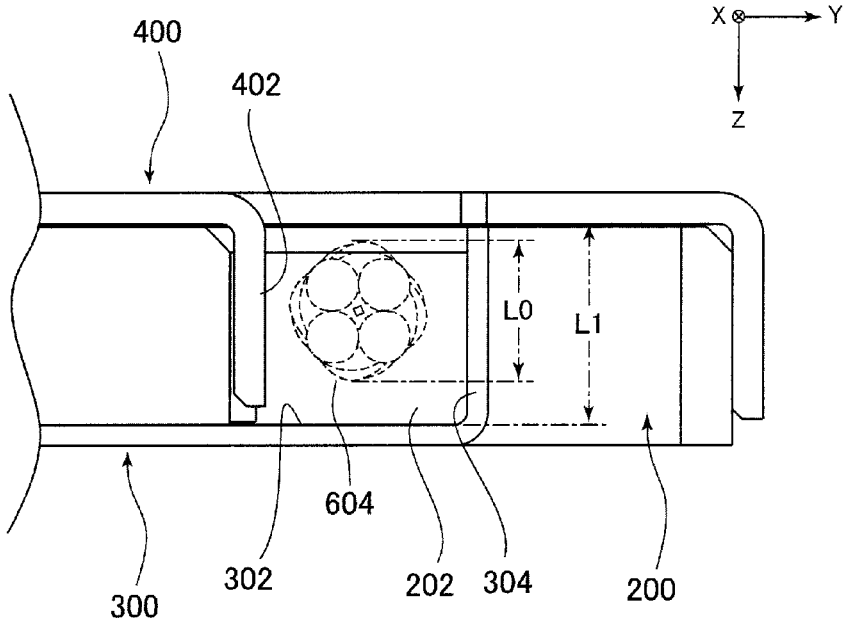
FIG. 7 is a rear view showing around the accommodating portion of FIG. 5. An outline of the drain wire is illustrated by dashed lines.

As shown in FIGS. 5 to 7, the base shell 300 has two fixing portions 302 to fix the drain wires 604, respectively. In other words, the fixing portion 302 is formed as a part of the base shell 300. Each of the fixing portions 302 exposes in a corresponding one of the accommodating portions 202 while covering bottom side of the accommodating portion 202. The connector 100 includes two fixing sets. Each of the fixing sets includes one accommodating portion 202 and one fixing portion 302. The contacts 500 are located between the two fixing sets in the Y-direction (pitch direction). As can be seen from the previous description, the fixing portions 302 are respectively formed on opposite sides of the base shell 300 in the Y-direction (pitch direction). The base shell 300 further has two strengthening portions 304. The strengthening portions 304 are placed in the accommodating portions 202, respectively. The strengthening portion 304 extends in a direction opposite to the predetermined direction (i.e., in the negative Z-direction) from the fixing portion 302 to a vicinity of the first plane 404 while covering one of opposite side walls of the accommodating portion 202. The cover shell 400 is formed with two connection portions 402. The connection portions 402 are placed in the accommodating portions 202, respectively. The connection portion 402 extends in the predetermined direction (positive Z-direction) from the first plane 404 to a vicinity of the fixing portion 302 while covering the other one of the opposite side walls of the accommodating portions 202. Thus, the strengthening portion 304 is arranged in the accommodating portion 202 and faces the connection portion 402 in the Y-direction.

As can be seen from FIGS. 1 and 2, the cable 600 has two drain wires 604. When the cable 600 is connected to connector 100, the drain wires 604 are fixed in the accommodating portions 202, respectively. As can be seen from FIGS. 2, 5 and 6, the end part of the drain wire 604 is accommodated in the accommodating portion 202 so as to be fixed to the fixing portion 302 in the accommodating portion 202 by soldering. In other word, the end part of the drain wire 604 is fixable to the fixing portion 302 within the accommodating portion 202. The end part of the drain wire 604 is also connectable and fixable to the connection portion 402 of the cover shell 400 within the accommodating portion 202. Therefore, the three members, namely, the cover shell 400, the drain wire 604 and the base shell 300 are mechanically and electrically connected firmly to one another so that a shielding capability can be improved.

According to the present embodiment, connection works between the contacts 500 and the signal conductors 603 are performable along the predetermined direction (Z-direction). Each of the connection works is a soldering operation that the contact 500 is soldered to the signal conductor 603, as mentioned above. In detail, when the signal conductor 603 of the signal wire 602 is connected to the contact 500, a plurality of the signal wires 602 are placed on the contacts 500. The signal wires 602 are respectively connected to the contacts 500 simultaneously by a machine like a pulse heating unit.

As shown in FIGS. 2, 5 and 6, the accommodating portion 202 has an opening at a top side thereof even after the cover shell 400 is attached to the holding member 200. Therefore, it is possible to watch the fixing portion 302 and the drain wire 604 along the Z-direction (predetermined direction) while the fixing portion 302 and the drain wire 604 are connected to each other within the accommodating portion 202. According to the present embodiment, subsequent to the connecting works of the signal conductors 603 with the contacts 500, the drain wire 604 can be connected to the fixing portion 302 without turning over the connector 100. Therefore, the connector 100 may be connected to the cable 600 more efficiently. Furthermore, the strengthening portion 304 is arranged in the accommodating portion 202 so that it is possible to strengthen a mechanical connection of the base shell 300 with the cover shell 400 by soldering.

As shown in FIG. 7, according to the present embodiment, the end part of the drain wire 604 is wholly accommodated within the accommodating portion 202. In other words, a distance L1 between the fixing portion 302 and the cover shell 400 in the predetermined direction is designed to be longer than a diameter L0 of the drain wire 604. Therefore, it is possible to make a sufficient room for soldering so that the solder can be prevented from flowing over the upper side of the accommodating portion 202.

The accommodating portion 202 according to the present embodiment is shaped in a depression. In detail, the accommodating portion 202 is formed on the rear end surface of the holding member 200, i.e. in one of the end portions in the X-direction (extending direction), so as to be depressed inwardly in the extending direction. However, the accommodating portion 202 may be formed at a different position. For example, the accommodating portion 202 may be located at a position which is apart from the end portions of the holding member 200 and which is out of a region occupied with the arranged contacts 500. In that case, the accommodating portion 202 is formed as, for example, a depression depressed in the Z-direction (predetermined direction). When the accommodating portion 202 is located apart from the rear end portion of the holding member 200, it is preferable to form a guide channel between the rear end portion of the holding member 200 and the accommodating portion 202 so as to guide the end part of the drain wire 604. Although the accommodating portion 202 according to the present embodiment is shaped in a roughly rectangular parallelepiped, the accommodating portion 202 may have a different shape. For example, as seen along the X-direction, the accommodating portion 202 may be shaped in a trapezoid which has a long top line and short bottom line extending in parallel.

The connector 100 according to the present embodiment is provided with two shells (the base shell 300 and the cover shell 400) which serve as shielding members. However, the base shell 300 and the cover shell 400 may be integrally formed. In other words, the connector 100 may be provided with one shell.

The connector 100 according to the present embodiment is the plug connector configured to be mated with the receptacle connector. However, the present invention can be applied to any types of connectors if the connector is provided with a shielding member and configured to be connected to a drain wire.

The present application is based on a Japanese patent application of JP2010-154331 filed before the Japan Patent Office on Jul. 6, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable to a cable having a plurality of signal wires and a drain wire, each of the signal wires including a signal conductor, the connector comprising:

a holding member being provided with an accommodating portion configured to accommodate an end part of the drain wire, the accommodating portion extending through the holding member along a predetermined direction;

a plurality of contacts configured to be connected to the signal conductors, respectively, the contacts being held by the holding member so that connection works between the contacts and the signal conductors are performable along the predetermined direction; and a shell covering, at least in part, the holding member, the shell having a fixing portion exposed in the accommodating portion so that the end part of the drain wire is fixable to the fixing portion within the accommodating portion.

2. The connector as recited in claim 1, the connector having a height or thickness in the predetermined direction.

3. The connector as recited in claim 1, wherein the fixing portion is designed so that the drain wire is soldered to the fixing portion.

4. The connector as recited in claim 1, wherein each of the connection works is a soldering operation that the contact is soldered to the signal conductor.

5. The connector as recited in claim 1, wherein the connector is configured so that the cable extends in a extending direction perpendicular to the predetermined direction when the cable is connected to the connector;

the holding member has end portions in the extending direction; and the accommodating portion is formed in one of the end portions and depressed in the extending direction.

6. The connector as recited in claim 1, wherein the contacts are held by the holding member so as to be arranged in a pitch direction perpendicular to the predetermined direction;

the connector includes two fixing sets, each of the fixing sets includes the accommodating portion and the fixing portion; and the contacts are located between two fixing sets in the pitch direction.

7. The connector as recited in claim 6, wherein the connector is configured so that the cable extends in an extending direction perpendicular to the predetermined direction when the cable is connected to the connector; and the shell has a first plane and a second plane arranged to sandwich the holding member in the predetermined direction, each of the first plane and the second plane having a belt-like shape which extends in the pitch direction so as to cover two covered positions near the accommodating portions, respectively, each of the covered positions being close to the accommodating portion in the extending direction and corresponding to a position of the accommodating portion in the pitch direction.

8. The connector as recited in claim 1, wherein:

the shell is provided with a base shell and a cover shell;

the fixing portion is formed as a part of the base shell;

the cover shell is formed with a connection portion; and the connection portion is placed in the accommodating portion and extends in the predetermined direction so that the end part of the drain wire is also fixable to the connection portion within the accommodating portion.

9. The connector as recited in claim 8, wherein a distance between the fixing portion and the cover shell in the predetermined direction is designed to be longer than a diameter of the drain wire.

10. The connector as recited in claim 8, wherein the base shell is further formed with a strengthening portion; and the strengthening portion is placed in the accommodating portion and extends from the fixing portion in a direction opposite to the predetermined direction.

11. The connector as recited in claim 10, wherein the strengthening portion is arranged in the accommodating portion and faces the connection portion.

* * * * *